US009427089B2

(12) United States Patent
Marsden et al.

(10) Patent No.: US 9,427,089 B2
(45) Date of Patent: Aug. 30, 2016

(54) BED RAIL

(71) Applicant: Cosco Management, Inc., Wilmington, DE (US)

(72) Inventors: Andrew W Marsden, Hingham, MA (US); Raul G Pereira, Cumberland, RI (US)

(73) Assignee: Dorel Juvenile Group, Inc., Foxboro, MA (US)

( * ) Notice: Subject to any disclaimer, the term of this patent is extended or adjusted under 35 U.S.C. 154(b) by 42 days.

(21) Appl. No.: 14/207,159

(22) Filed: Mar. 12, 2014

(65) Prior Publication Data

US 2014/0259401 A1 Sep. 18, 2014

Related U.S. Application Data

(60) Provisional application No. 61/800,575, filed on Mar. 15, 2013.

(51) Int. Cl.
*A47C 21/08* (2006.01)
*A47D 7/00* (2006.01)

(52) U.S. Cl.
CPC ..... *A47C 21/08* (2013.01); *A47D 7/00* (2013.01)

(58) Field of Classification Search
CPC ..... A47C 21/08; A47D 7/00; A61G 7/0507
USPC ..... 5/425, 426
See application file for complete search history.

(56) References Cited

U.S. PATENT DOCUMENTS

| | | | | |
|---|---|---|---|---|
| 2,071,155 | A | 2/1937 | Alexander | |
| 2,447,204 | A | 8/1948 | Piotrowski | |
| 2,959,293 | A | 11/1960 | Von Meyer | |
| 3,290,701 | A | 12/1966 | Luff | |
| 3,419,922 | A | 1/1969 | Malherbe | |
| 3,932,903 | A | 1/1976 | Adams et al. | |
| 4,186,456 | A | 2/1980 | Huempfner | |
| 4,612,679 | A | 9/1986 | Mitchell | |
| 4,641,385 | A | 2/1987 | Peters et al. | |
| 4,727,559 | A | 2/1988 | Yokoyama et al. | |
| 4,747,171 | A | 5/1988 | Einsele et al. | |
| 5,038,430 | A | 8/1991 | Bly | |
| 5,394,580 | A | 3/1995 | Foster et al. | |
| 5,481,772 | A | 1/1996 | Glynn et al. | |
| 5,519,905 | A | 5/1996 | Bernstein et al. | |
| 5,522,100 | A | 6/1996 | Schilling et al. | |
| 5,577,277 | A | 11/1996 | Sundberg et al. | |
| 5,781,945 | A | 7/1998 | Scherer et al. | |
| 5,784,732 | A | 7/1998 | Vail | |
| 6,021,533 | A | 2/2000 | Ellis et al. | |
| 6,446,283 | B1 | 9/2002 | Heimbrock et al. | |
| 6,829,856 | B1 | 12/2004 | Moorman | |
| 6,886,196 | B2 | 5/2005 | Nygren et al. | |
| 6,934,984 | B2 | 8/2005 | Marsden et al. | |
| 6,952,846 | B2 | 10/2005 | Flannery et al. | |
| 7,103,928 | B1 * | 9/2006 | Childs | 5/426 |
| 7,137,158 | B2 | 11/2006 | Flannery et al. | |
| 7,181,184 | B1 | 2/2007 | Dimeo et al. | |
| 7,181,788 | B2 | 2/2007 | Flannery et al. | |
| 7,302,720 | B2 | 12/2007 | Flannery et al. | |

(Continued)

*Primary Examiner* — David E Sosnowski
*Assistant Examiner* — Myles Throop
(74) *Attorney, Agent, or Firm* — Barnes & Thornburg LLP

(57) ABSTRACT

A bed rail is configured to be mounted on a mattress. The bed rail includes a base arranged to extend under the mattress and a side rail coupled to the base and configured to include a portion arranged to lie above the mattress.

20 Claims, 8 Drawing Sheets

(56) References Cited

U.S. PATENT DOCUMENTS

| | | | | |
|---|---|---|---|---|
| 7,373,679 | B2 | 5/2008 | Miller | |
| 7,640,606 | B2 | 1/2010 | Flannery et al. | |
| 7,870,622 | B2 | 1/2011 | Nygren et al. | |
| 7,913,333 | B2 | 3/2011 | Flannery et al. | |
| 6,952,846 | C1 | 8/2012 | Flannery et al. | |
| 7,137,158 | C1 | 8/2012 | Flannery et al. | |
| 2003/0024047 | A1 | 2/2003 | Wu | |
| 2004/0123387 | A1* | 7/2004 | Marsden et al. | 5/426 |
| 2007/0083994 | A1* | 4/2007 | Miller | 5/662 |
| 2011/0179569 | A1* | 7/2011 | Hayano et al. | 5/426 |
| 2012/0084616 | A1 | 4/2012 | Wentink | |
| 2012/0084915 | A1 | 4/2012 | Flannery et al. | |

* cited by examiner

BED RAIL

PRIORITY CLAIM

This application claims priority under 35 U.S.C. §119(e) to U.S. Provisional Application Ser. No. 61/800,575, filed Mar. 15, 2013, which is expressly incorporated by reference herein.

BACKGROUND

The present disclosure relates to bed rails, and in particular, to bed rails used with beds to help retain individuals in bed. More particularly, the present disclosure relates to bed rails for mounting on a mattress to retain young children in bed.

SUMMARY

According to the present disclosure, a bed rail comprises a side rail and a side-rail support base coupled to a lower portion of the side rail. The side-rail support base is arranged to be inserted into a space provided between a mattress and a box spring underlying the mattress to support the side rail in an upright orientation extending along an outwardly facing perimeter side edge of the mattress.

In illustrative embodiments, the side rail includes a stationary unit coupled to the side-rail support base and a movable barrier unit mounted for up-and-down movement on the stationary unit to engage a top surface of the mattress at the option of a caregiver. When the movable barrier unit is moved by a caregiver to engage the top surface of the mattress, the bed rail is clamped to the mattress and the movable barrier unit provides an upright perimeter fence on top of the mattress. The stationary unit includes two upright stationary posts arranged to lie in spaced-apart parallel relation to one another to define a vertical reference plane. The movable barrier unit includes a movable panel-support mounted for up-and-down movement on each of the upright stationary posts under the control of a caregiver.

In illustrative embodiments, the movable barrier unit further comprises an inclined inner panel having an upper portion coupled to the movable panel supports and a lower portion that is arranged to extend downwardly toward the underlying base to mate with a mattress lying on the base. The inclined inner panel is arranged to lie in angular relation to the vertical reference plane established by the upright stationary posts to slope downwardly toward an inner region on the top surface of the mattress. The lower portion of the inclined inner panel is arranged to overlie a top surface of the mattress to extend along an offset mattress-contact line that is arranged to lie in spaced-apart relation to the perimeter side edge of the mattress. In illustrative embodiments, the mattress is a spring mattress and the distance between the perimeter side edge and the offset mattress-contact line is greater than the horizontally extending width of an outermost vertically oriented mattress spring located in the mattress.

In illustrative embodiments, the inclined inner panel is arranged to be moved relative to the side-rail support base to trap the mattress therebetween so that the bed rail is clamped to the mattress during downward movement of the movable panel supports on the upright stationary posts. Each movable panel support is triangle-shaped in an illustrative embodiment.

In illustrative embodiments, a motion-control mechanism is provided in the side rail to provide operator-controlled means for moving movable first and second panel supports and the inclined inner panel as a unit up and down on the upright stationary posts that are coupled to the side-rail support base and to a mattress that extends into a space provided between the base and a lower portion of the inclined inner panel. The motion-control mechanism functions to cause the movable barrier unit comprising the first and second panel supports and the inclined inner panel mounted on the first and second panel supports to move downwardly toward the underlying base to apply clamping force to the mattress lying therebetween.

Additional features of the present disclosure will become apparent to those skilled in the art upon consideration of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION

Figure 1:
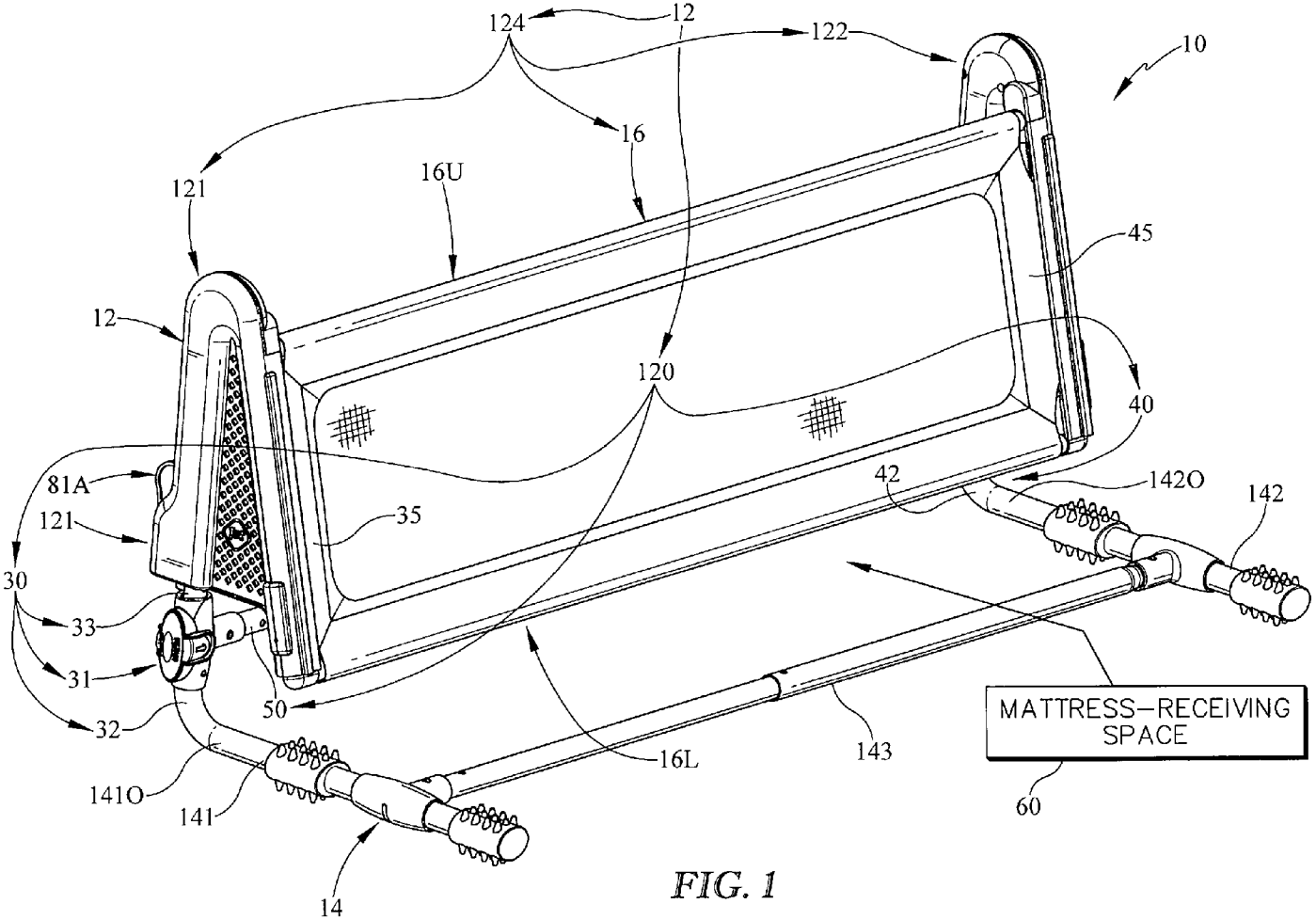
FIG. 1 is a perspective view of a bed rail in accordance with the present disclosure showing that the bed rail includes a base and a side rail extending upwardly from a far end of the base and including an inclined inner panel extending downwardly at an angle toward a middle portion of the base to define a laterally extending mattress-receiving space below a lower edge of the inclined inner panel and the base.
Figure 2:
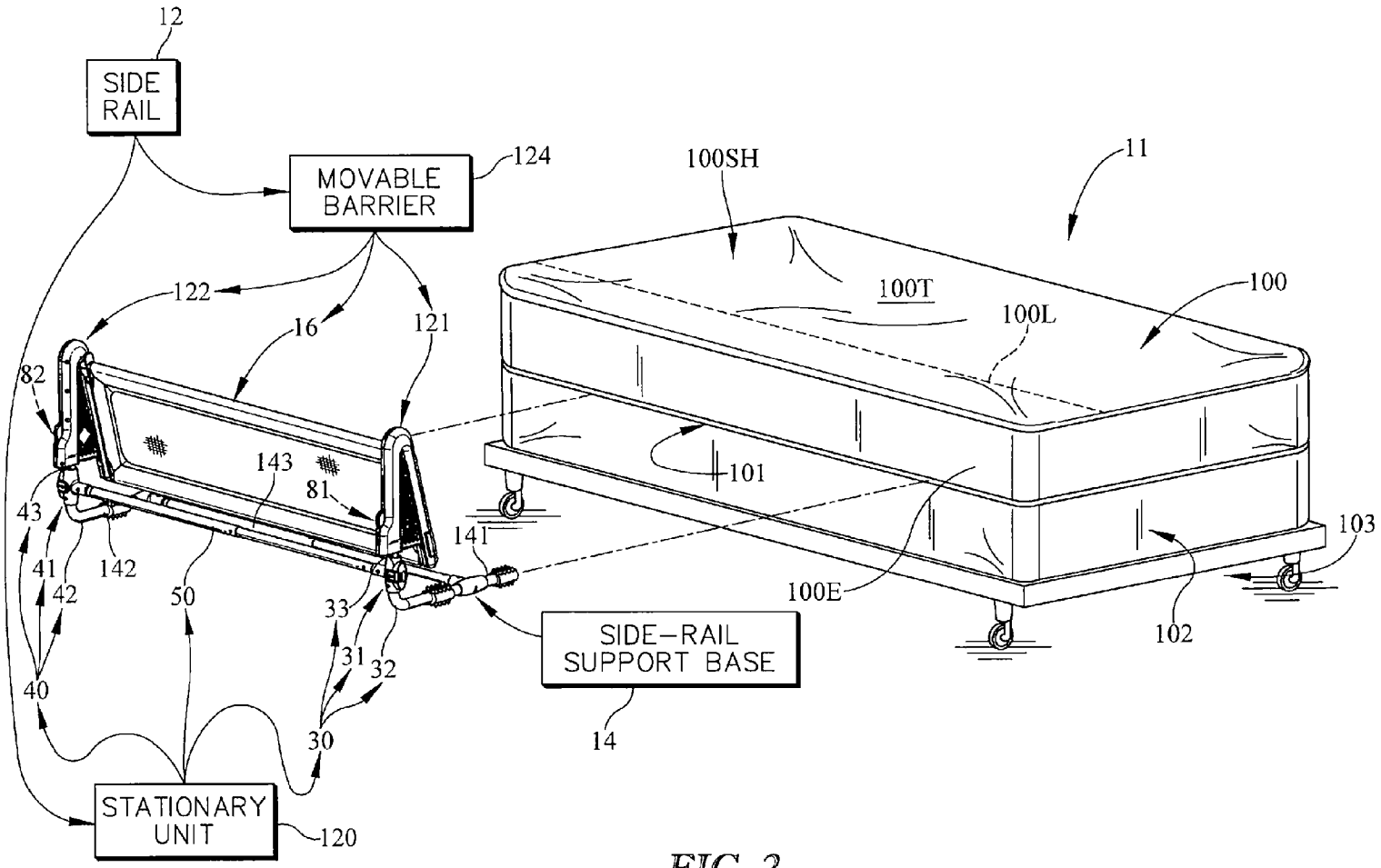
FIG. 2 is a perspective view of the bed rail of FIG. 1 taken from another point of view (and before the bed rail is clamped to a mattress supported on a box spring included in a bed) showing that the side rail comprises (1) a stationary unit including a T-shaped first hub (on the right) coupled to a first-end anchor leg included in the base, a second T-shaped hub (on the left) coupled to a second-end anchor leg included in the base, a horizontally extending and telescoping stretcher bar extending from the first hub to the second hub, an upright first stationary post coupled to the first hub and an upright second stationary post coupled to the second hub and (2) a movable barrier unit including a triangle-shaped upright movable first panel support mounted for up-and-down movement on the upright first stationary post, a triangle-shaped upright movable second panel support mounted for up-and-down movement on the upright stationary second post, and an inclined inner panel, and showing that the inclined inner panel is coupled at one end (on the right) to the movable first panel support and at an opposite end (on the left) to the movable second panel support to form a movable barrier unit that is able to move in a downward direction on the upright first and second stationary posts of the stationary unit to apply a clamping force to a mattress lying on the base as shown in FIGS. 3A and 3B.
Figure 3A:
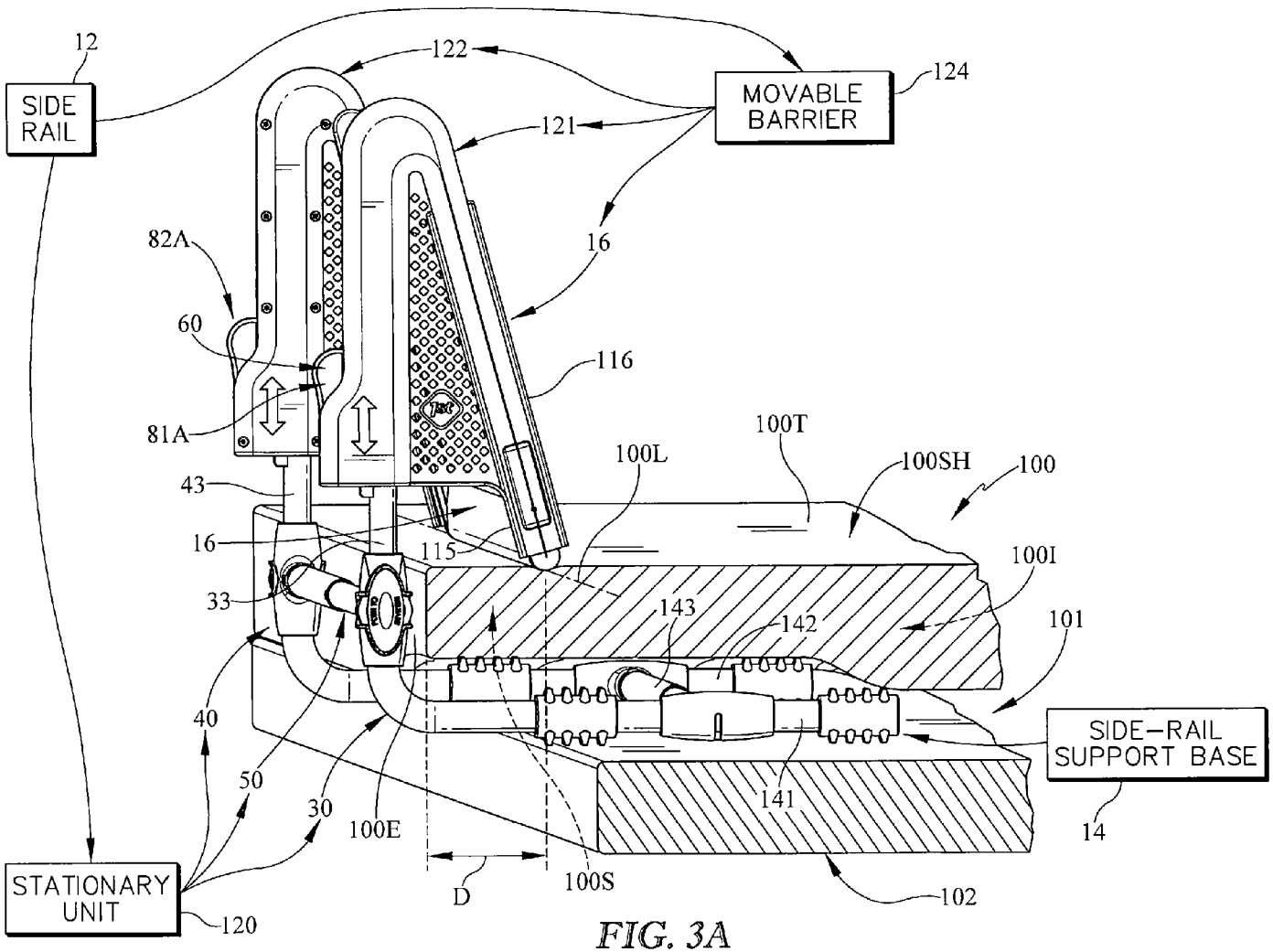
FIG. 3A is another perspective view of the bed rail of FIGS. 1 and 2 showing a diagrammatic representation of a mattress clamped between the base and the lower portion of the inclined inner panel of the movable barrier along a mattress contact line that is offset inwardly from the perimeter side edge of the mattress located near to the stationary unit with a lower portion of the mattress broken away to reveal portions of the base trapped between the mattress and the underlying box spring.
Figure 3B:
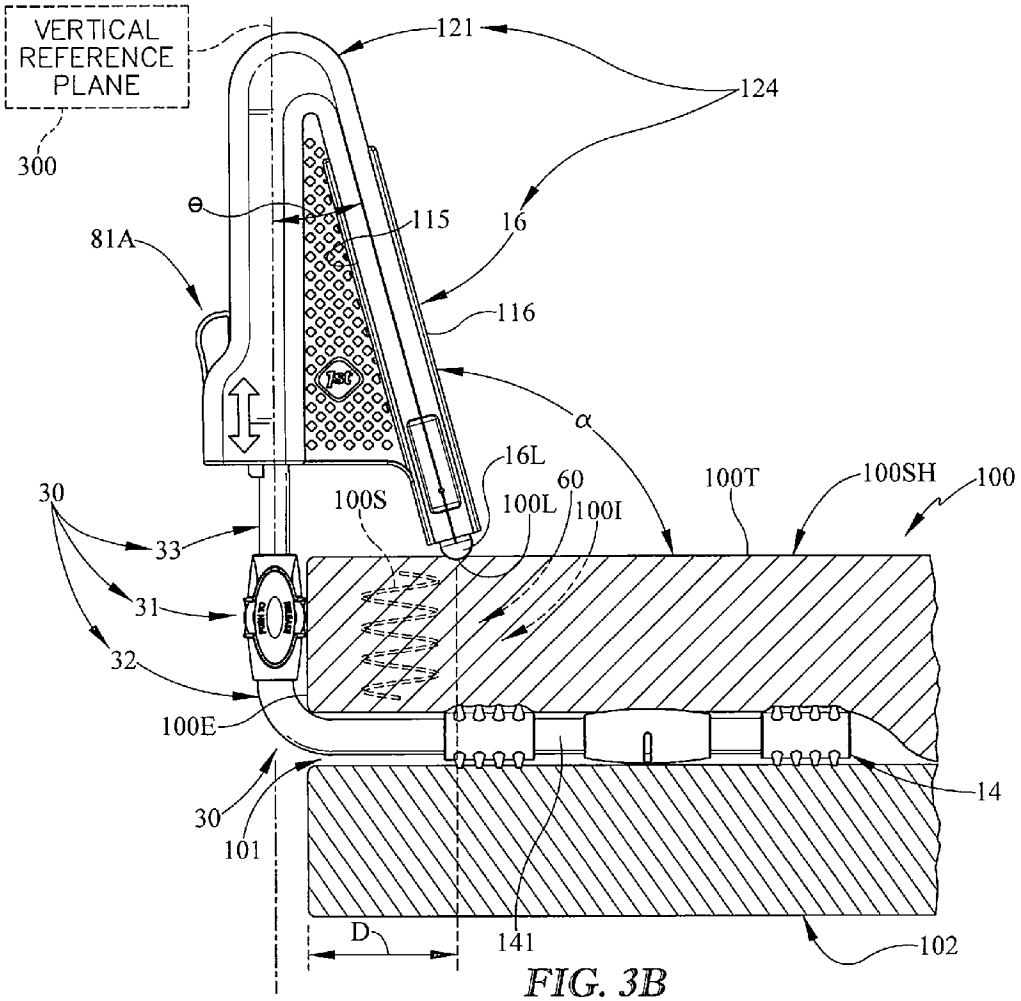
FIG. 3B is a side elevation view that is similar to FIG. 3A showing (in phantom and diagrammatically) an outermost vertically oriented mattress spring positioned to lie in an interior region of a mattress shell included in the mattress and showing that the inclined inner panel of the movable barrier unit is arranged to lie in angular relation to a vertical reference plane established by the upright stationary posts included in the stationary unit to slope downwardly toward an inner region on the top surface of the mattress and to cause a lower edge of the inclined inner panel to extend along an offset mattress-contact line (see also FIG. 3A) that is arranged to lie in spaced-apart relation to a perimeter side edge of the mattress to locate the outermost vertically oriented mattress spring therebetween.

A bed rail 10 in accordance with the present invention comprises a side rail 12 and a side-rail support base 14 coupled to a lower portion of side rail 12 as shown, for example, in FIGS. 1-3. Side-rail support base 14 is arranged to be inserted into a space 101 provided in a bed 11 between a mattress 100 and a box spring 102 underlying mattress 100 as suggested in FIG. 2 to support side rail 12 in an upright orientation extending along an outwardly facing perimeter side edge 100E of mattress 100 as suggested in FIGS. 3A and 3B.

An inclined inner panel 16 included in side rail 12 and shown in FIG. 1 is movable at the option of a caregiver to contact a top surface 100T of mattress 100 as suggested in FIGS. 3A and 3B to clamp bed rail 10 to mattress 100. A lower portion 16L of inclined inner panel 16 contacts mattress 100 along a mattress-contact line 100L that is offset a distance "D" from a nearby perimeter edge 100E of mattress 100.

Side-rail support base 14 includes a first anchor leg 141, a second anchor leg 142 arranged to lie in spaced-apart relation to first anchor leg 141, and an extensible stretcher bar 143 arranged to interconnect middle portions of first and second anchor legs 141, 142 as shown, for example, in FIG. 1. An outer end 141O of first anchor leg 141 is coupled to a first foundation 30 included in side rail 12. An outer end 142O of second anchor leg 142 is coupled to a second foundation 40 included in side rail 12.

Side rail 12 includes a stationary unit 120 that is coupled to side-rail support base 14 and a movable barrier unit 124 that is mounted on stationary unit 120 as shown in FIGS. 1 and 2 for up-and-down movement relative to a mattress as suggested in FIG. 3A. Stationary unit 120 is coupled to first and second anchor legs 141, 142 of side-rail support base 14 and arranged to lie alongside perimeter side edge 100E of mattress 100 when bed rail 10 is clamped to mattress 100 as suggested in FIGS. 2, 3A, and 3B. Movable barrier unit 124 includes inclined inner panel 16 and is arranged to move up and down on stationary unit 120 as suggested diagrammatically in FIGS. 3A and 3B.

Stationary unit 120 includes a first foundation 30, a second foundation 40, and a horizontally extending and telescoping (and removable) stretcher bar 50 arranged to interconnect first and second foundations 30, 40 as suggested in FIGS. 1 and 2. First foundation 30 includes a first T-shaped hub 31 coupled to one end of stretcher bar 50, a first elbow 32 arranged to interconnect first T-shaped hub 31 and outer end 141O of first anchor leg 141, and a first stationary post 33 coupled to first T-shaped hub 31 and arranged to extend upwardly away from first elbow 32. Second foundation 40 includes a second T-shaped hub 41, a second elbow 42 arranged to interconnect second T-shaped hub 41 and outer end 142O of second anchor leg 142, and a second stationary post 43 coupled to second T-shaped hub 41 and arranged to extend upwardly away from second elbow 42.

Movable barrier unit 124 includes an inclined inner panel 16, a movable first panel support 121, and a movable second panel support 122 as shown, for example, in FIGS. 1 and 2. Movable first panel support 121 is mounted for up-and-down movement on a first stationary post 33 included in first foundation 30. A companion movable second panel support 122 is mounted for up-and-down movement on a second stationary post 43 included in second foundation 40. A first end 35 of inclined inner panel 16 is coupled to movable first panel support 121 and an opposite second end 45 of inclined inner panel 16 is coupled to movable second panel support 122 so that inclined inner panel 16 and first and second panel supports 121, 122 cooperate to form a movable barrier unit 124 that can be (1) moved (as a unit) on the first and second stationary posts 33, 43 included in stationary unit 120 of side rail 12 to clamp mattress 100 between movable barrier 124 and base 14 and (2) moved up (as a unit) on the first and second stationary posts 33, 43 included in stationary unit 120 of side rail 12 to unclamp mattress 100.

In illustrative embodiments, inclined inner panel 16 includes an upper portion 16U detachably coupled to movable panel supports 121, 122 and a lower portion 16L that is arranged to extend downwardly toward the underlying base 14 as suggested in FIG. 1. Inclined inner panel 16 is arranged to lie in spaced-apart relation to stationary unit 120 to slope downwardly toward an inner region on a top surface 100T of mattress 100 as shown, for example, in FIGS. 3A and 3B. Inclined inner panel 16 is arranged to lie in angular relation to a vertical reference plane 300 arranged to intersect both first and second stationary posts 33, 43 in side rail 12 as suggested in FIG. 3B to define an acute angle θ therebetween. The measure of angle θ is about 100° (e.g., 105°) in an illustrative embodiment.

Lower portion 16L of the inclined inner panel 16 of movable barrier unit 124 is arranged to overlie a top surface 100T of mattress 100 to extend along a mattress-contact line 100L that is arranged to lie in spaced-apart relation to the perimeter side edge 100E of mattress 100. In illustrative embodiments the distance D between the perimeter side edge 100E and the mattress-contact line 100L is greater than the horizontally extending width of an outermost vertically oriented mattress spring 100S (shown in phantom) provided in an interior region (100I) of a shell 100SH included in mattress 100 and located near to perimeter side edge 100E of mattress 100 as suggested in FIG. 3.

In illustrative embodiments, base 14 and inclined inner panel 16 are arranged to be moved toward (and away) from one another to trap (and untrap) mattress 100 therebetween so that bed rail 10 is clamped to mattress 10 as suggested in FIGS. 3A and 3B. A motion-control mechanism 80 is provided in side rail 12 to provide operator-controlled means for moving the panel supports 121, 122 included in movable barrier unit 124 and inclined inner panel 16 also included in movable barrier unit 124 up and down relative to base 14 and to a mattress 100 extending into a mattress-receiving space 60 provided between base 14 and a lower portion 16L of inclined inner panel 16. The motion-control mechanism 80 functions to move the inclined inner panel 16 toward the underlying base 14 to apply clamping force to mattress 100 lying therebetween.

Inclined inner panel 16 is mounted to lie at an angle θ with respect to the vertical reference plane 300 as shown, for example, in FIG. 3B to help keep a child at rest on mattress 100 centered on mattress 100. Inclined inner panel 16 is sloped downwardly to lie near an inner region of the top surface 100T of mattress 100 to lie in offset relation to a perimeter side edge 100E of mattress 100 to lessen chance of a potential gap between the panel 16 and mattress 100. Inclined inner panel 16 is placed a distance D inside the perimeter side edge 100E of mattress 100 while still making it easy for a parent to lean over bed rail 10 and pick up a child on mattress 100.

Figure 7:
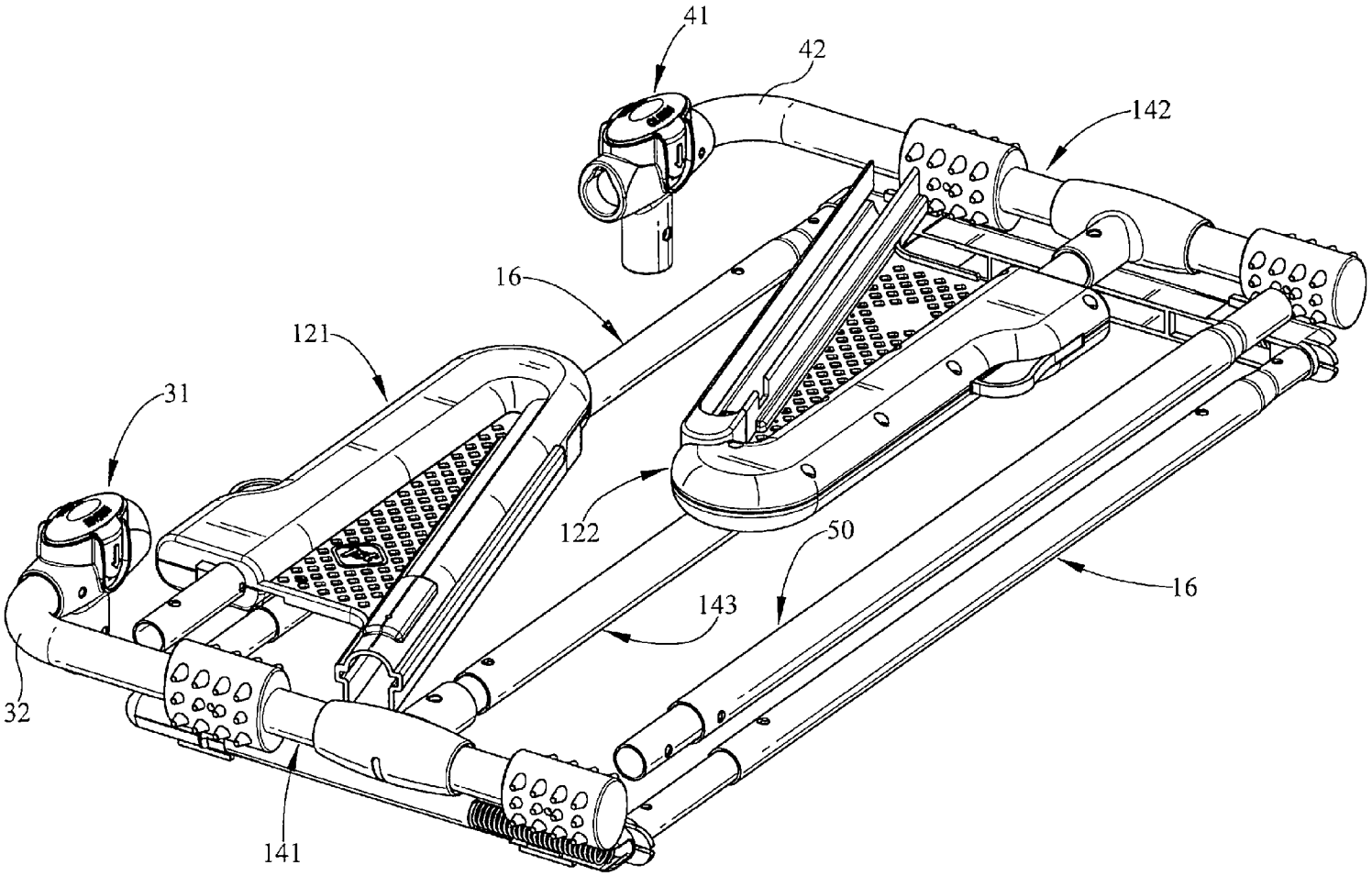
FIG. 7 is a perspective view of the bed rail of FIGS. 1-3B in an illustrative collapsed configuration for shipment in a retail package.

A movable barrier unit 124 comprising movable first and second support panels 121, 122 of side rail 12 and inclined inner panel 16 can be separated from base 14 while base 14 remains trapped between mattress 100 and an underlying companion box spring 102. Thus, movable barrier unit 124 is removable for ease of bed making and to assist older children in entering or exiting the bed. This movable barrier unit 124 is sized to be stored easily in a space 103 provided under the bed 11 when not in use and while the base 14 remains in place between the mattress 100 and the box spring 102 as suggested in FIGS. 2 and 7.

Figure 5:
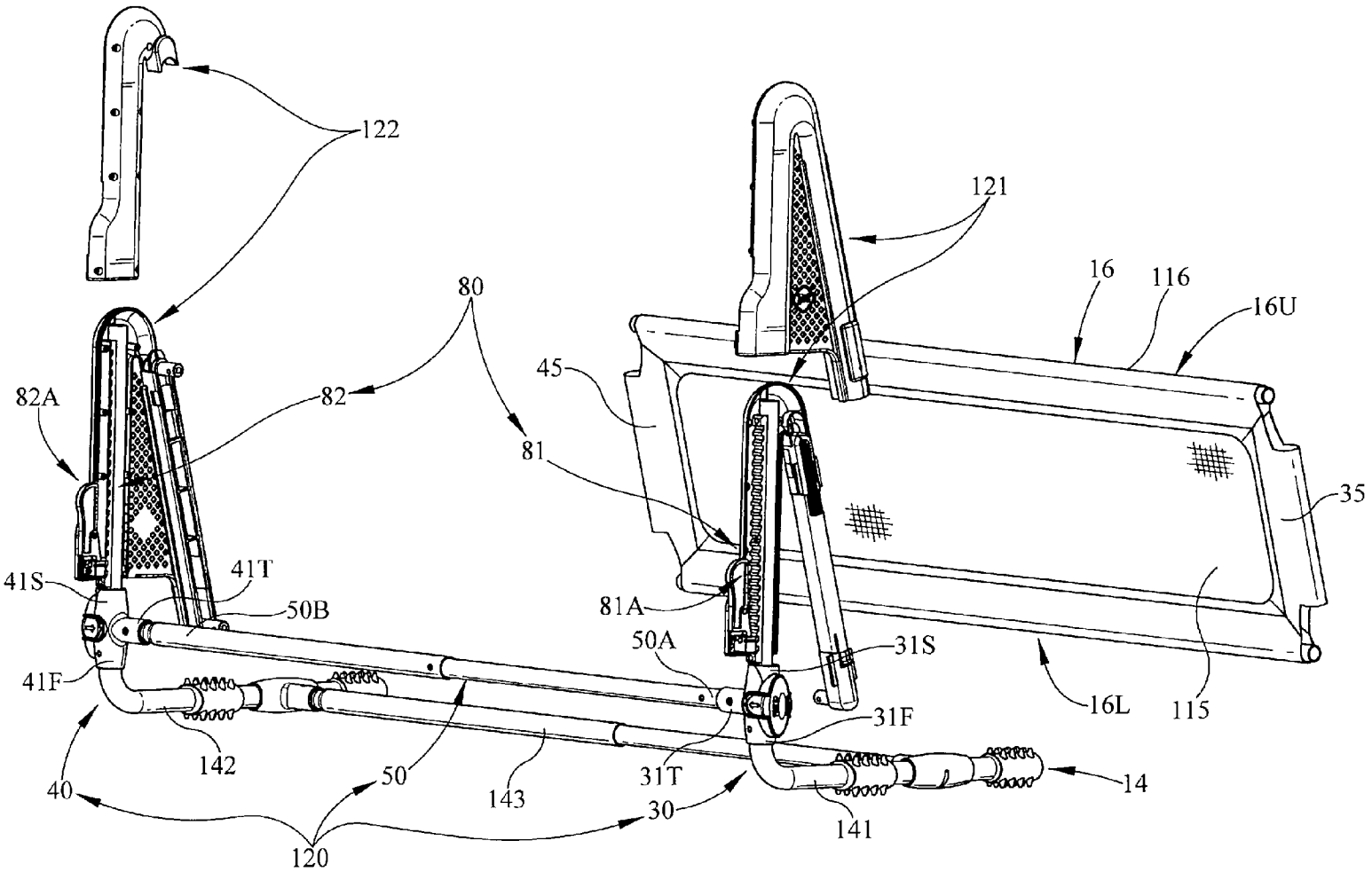
FIG. 5 is an exploded perspective view of components included in the bed rail showing the inclined inner panel separated from the movable first and second panel supports and showing components included in a first ratchet of the motion-control mechanism that is associated with the upright first stationary post and that are visible after removal of an outer shell included in the first panel support and showing components included in a second ratchet of the motion-control mechanism that is associated with the upright second stationary post and that are visible after removal of an inner shell included in the second panel support.
Figure 6:
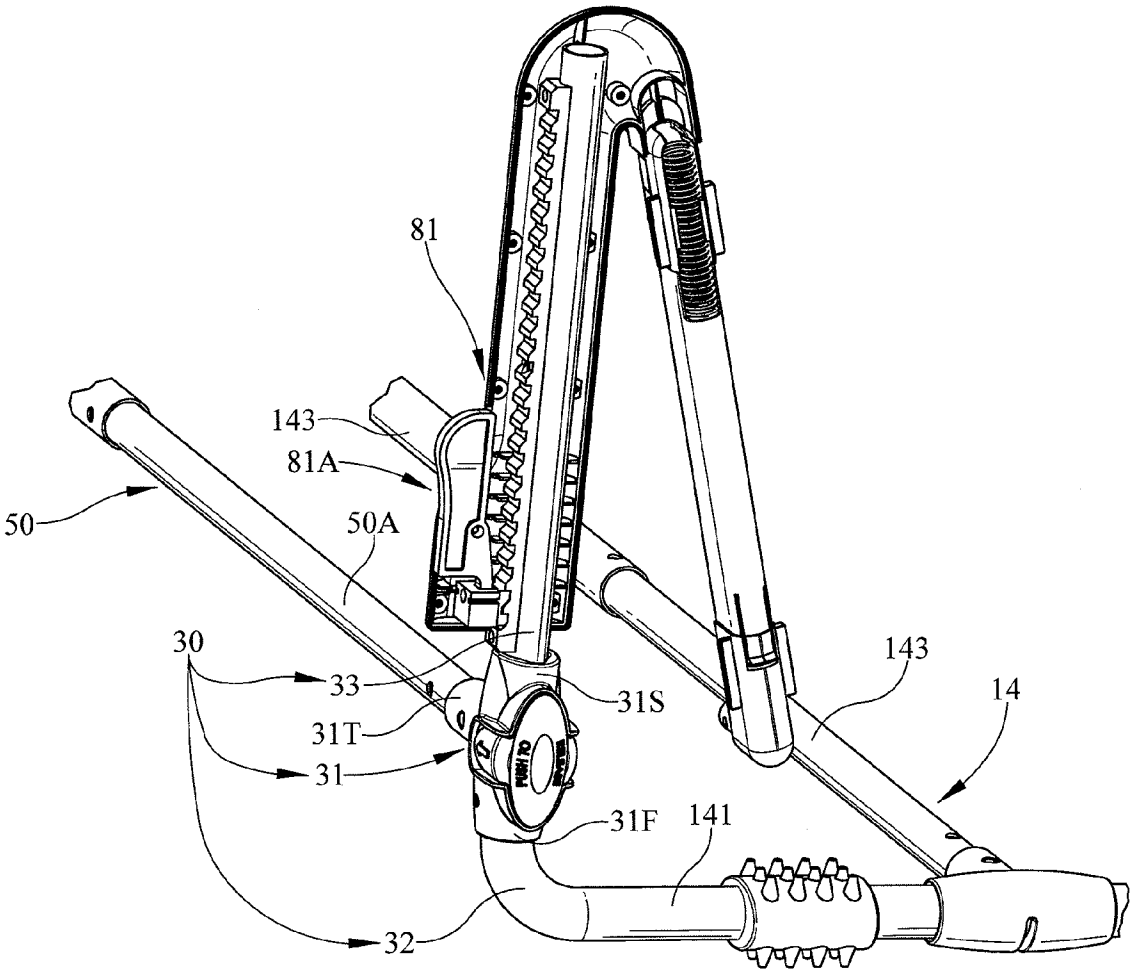
FIG. 6 is an enlarged view of the first ratchet shown in FIG. 5.

The movable barrier unit 124 can be raised and lowered relative to the base 14 by operating a motion-control mechanism 80 including a first ratchet 81 associated with first stationary post 33 and a first hub 31 of side rail 12 and a second ratchet 82 associated with second stationary post 43 and a second hub 41 of side rail 12. These ratchets 81, 82 are shown, in more detail, for example, in FIGS. 5 and 6 and can be operated easily by a caregiver to apply clamping force to the mattress 100 to reduce and minimize lateral displacement. First ratchet 81 includes a hand-operated ratchet actuator 81A while second ratchet includes a hand-operated ratchet actuator 82A. Bed rail 10 is designed so that it can be folded, collapsed, and shipped partially assembled as suggested in FIG. 7.

Bed rail 10 includes a side-rail support base 14 adapted to be positioned under a mattress 100 in a stationary position and a side rail 12 including a stationary foundation unit 120 and a movable barrier unit 124 as shown, for example, in FIGS. 1 and 2. Stationary foundation 120 is coupled to side-rail support base 14 to extend upwardly along and above a perimeter side edge 100E of mattress 100. Movable barrier unit 124 is mounted for up-and-down movement on a stationary foundation unit 120 relative to side-rail support base 14 between a lowered clamped position to clamp the mattress 100 between side-rail support base 14 and movable barrier unit 124 and a raised unclamped position separated from the mattress 100 to unclamp the mattress 100.

Movable barrier unit 124 includes an inclined inner panel 16 that includes a lower portion 16L that is arranged as shown in FIGS. 3A and 3B to overlie a top surface 100T of the mattress 100 to extend along an offset mattress-contact line 100L that is provided on top surface 100T of mattress 100 and arranged to lie in spaced-apart relation to perimeter side edge 100E of mattress 100 when side-rail support base 14 is positioned under mattress 100 and movable barrier unit 124 occupies the lowered clamped position. Inclined inner panel 16 includes an outwardly facing surface arranged to face toward stationary foundation unit 120 and an inwardly facing surface arranged to face away from stationary foundation unit 120 and toward a person at rest on mattress 100 as suggested in FIGS. 2 and 3B. The inwardly facing surface of inclined inner panel 16 and top surface 100T of mattress 100 cooperate to define an obtuse included angle θ therebetween when movable barrier unit 124 occupies the lowered clamped position as suggested in FIG. 3B. The measure of the obtuse angle θ is about 105°.

Movable barrier unit 124 further includes a movable first panel support 121 mounted for up-and-down movement on a first stationary post 33 included in stationary foundation unit 120. Inclined inner panel 16 is coupled to movable first panel support 121 for movement therewith relative to first stationary post 33 during movement of movable barrier unit 124 between the lowered clamped position and the raised unclamped position.

Movable barrier unit 124 further includes a movable second panel support 122 mounted for up-and-down movement on a second stationary post 43 included in foundation stationary unit 120 and arranged to lie in substantially spaced-apart parallel relation to first stationary post 33. A first end portion of inclined inner panel 16 is coupled to the movable first panel support 121 to move therewith. A second end portion of inclined inner panel 16 is coupled to the movable second panel support 122 to move therewith and to establish the obtuse angle θ.

Side-rail support base 14 includes a first anchor leg 141 adapted to extend under the mattress 100 and a second anchor leg 142 adapted to extend under the mattress 100 and lie in spaced-apart relation to first anchor leg 141 as shown in FIG. 3A. Side-rail support base 14 also includes a stretcher bar 143.

Stationary foundation unit 120 includes a stretcher bar 50 arranged to extend along and in laterally spaced-apart relation to inclined inner panel 16, a first foundation 30, and a second foundation 40 as shown in FIGS. 2 and 3A. First foundation 30 is coupled to first anchor leg 141 and to a first end of stretcher bar 50 and configured to include first stationary post 33. Second foundation 40 is coupled to second anchor leg 142 and to an opposite second end of stretcher bar 50 and configured to include second stationary post 43.

Figure 4:
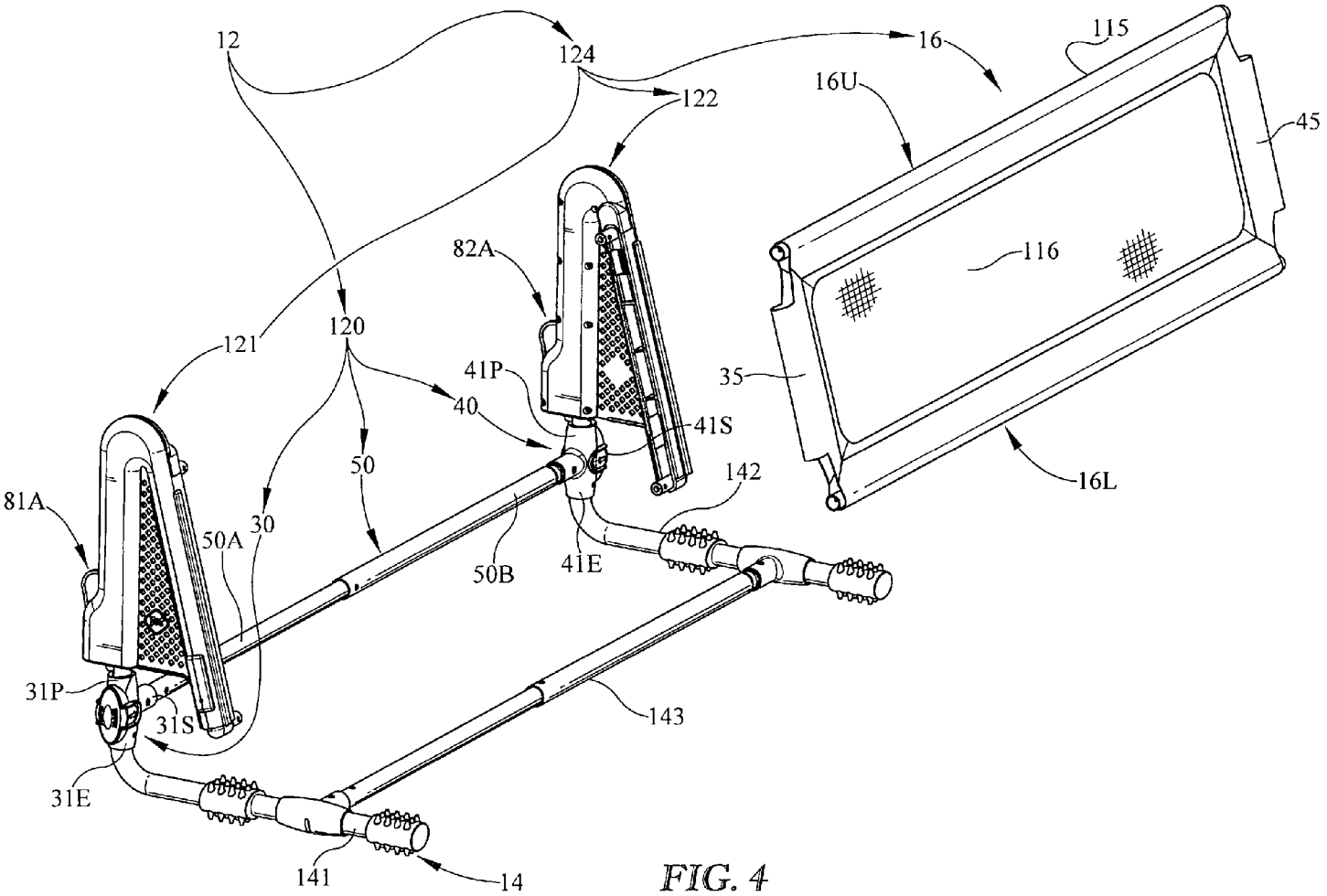
FIG. 4 is a perspective view of the bed rail of FIGS. 1-3B showing the inclined inner panel after it has been removed from its mounted position on the movable triangle-shaped upright movable first and second panel supports.

First foundation 30 includes a first elbow 32 coupled to an outer end of the first anchor leg 141 and a first T-shaped hub 31 including a first hub segment 31E coupled to first elbow 32, a second hub segment 31P coupled to first stationary post 33, and a third hub segment 31S coupled to the first end of stretcher bar 50 as shown in FIG. 4. Second foundation 40 includes a second elbow 42 coupled to an outer end of second anchor leg 142 and a second T-shaped hub 41 including a first hub segment 41E coupled to second elbow 42, a second hub segment 41P coupled to second stationary post 43, and a third hub segment 41S coupled to the opposite second end of stretcher bar 50 as shown in FIG. 4.

Movable barrier unit 124 further includes first panel-support lock means 81 arranged to interconnect first stationary post 33 and the movable first panel support 121 for selectively locking the movable first panel support 121 in a stationary position on the first stationary post 33 of stationary foundation unit 120 after sliding movement of the movable first panel support 121 on first stationary post 33 to establish the lowered clamped position of movable barrier unit 124 so that a first end of the lower portion 16L of inclined inner panel 16 adjacent to the movable first panel support 121 is placed on the offset mattress-contact line 100L as suggested in FIGS. 3A and 3B. Movable barrier unit 124 also includes second panel-support lock means 82 arranged to interconnect second stationary post 43 and movable second panel support 122 for selectively locking the movable second panel support 122 in a stationary position on second stationary post 43 of stationary foundation unit 120 after sliding movement of the movable second panel support 122 on second stationary post 43 to help establish the lowered clamped position of movable barrier unit 124 so that an opposite second end of lower portion 16L of inclined inner panel 16 adjacent to the movable second panel support 122 is placed on the offset mattress-contact line 100L as suggested in FIG. 3A.

First panel-support lock means 81 provides a first lock system coupled to first stationary post 33 and to movable barrier unit 124. Second panel-support lock means 82 provides a second lock system coupled to second stationary post 43 and to movable barrier unit 124. The first and second lock systems 81, 82 cooperate to provide an operator-controlled means 80 for moving movable barrier unit 124 during up-and-down movement of movable barrier unit 124 on first and second stationary posts 33, 43 relative to side-rail support base 14. Lock system 81 includes a hand-operated actuator 81A while lock system 82 includes a hand-operated actuator 82A as shown, for example, in FIG. 5.

Movable barrier unit 124 is mounted for up-and-down movement relative to side-rail support base 14 on the first and second foundations 30, 4. First stationary post 33 is arranged to extend above the first T-shaped hub 31 and upwardly away from the first elbow 32 to engage and maintain contact with movable barrier unit 124 during up-and-down movement of movable barrier unit 124 on the first stationary post 33 relative to side-rail support base 14. Second stationary post 43 is arranged to extend above second T-shaped hub 41 and upwardly away from the second elbow 42 to engage and maintain contact with movable barrier unit 124 during up-and-down movement of movable barrier unit 124 on the second stationary post 43 relative to the side-rail support base 14.

Bed rail 10 includes a side rail 12 including an inclined inner panel 16 and a side-rail support base 14 coupled to a lower portion of the side rail 12. Side-rail support base 14 is arranged to be inserted into a space 101 provided between a mattress 100 and a box spring 102 underlying the mattress 100 to support side rail 12 in an upright orientation extending along an outwardly facing perimeter side edge 100E of mattress 100 as suggested in FIGS. 3A and 3B.

Side rail 12 further includes a stationary unit 120 coupled to the side-rail support base 14. Stationary unit 120 includes two upright stationary posts 33, 43 arranged to lie in spaced-apart parallel relation to one another to define a vertical reference plane 300 as suggested in FIG. 3B.

Side rail 12 also includes a movable panel-support 121 or 122 mounted for up-and-down movement on each of the upright stationary posts 33, 43 under the control of a caregiver. Inclined inner panel 16 has an upper portion coupled to the movable panel supports 121, 122 included in side rail 12 and a lower portion that is arranged to extend downwardly toward the underlying base 14 to mate with a mattress 100 lying on the base 14. Inclined inner panel 16 is arranged to lie in angular relation to the vertical reference plane 300 established by the upright stationary posts 33, 43 in side rail 12 to slope downwardly toward an inner region on the top surface 100T of mattress 100. Inclined inner panel 16 is arranged to be moved on the movable panel supports 121, 122 included in side rail 12 relative to side-rail support base 14 to trap the mattress 100 therebetween so that the bed rail 110 is clamped to the mattress 100. The lower portion 16L of inclined inner panel 116 is arranged to overlie a top surface 100T of mattress 100 to extend along an offset mattress-contact line 100L that is arranged to lie in spaced-apart relation to the perimeter side edge 100E of mattress 100.

Mattress 100 includes a shell 100SH formed to include an interior region 100I and the top surface 100T and vertically oriented mattress springs 100S located in the interior region 100I of the shell 100SH. The distance D between the perimeter side edge 101E and the offset mattress-contact line 100L is greater than a horizontally extending width of an outermost vertically oriented spring located in the interior region 100I of the shell 100SH of the mattress 100 as suggested in FIG. 3B.

The invention claimed is:

1. A bed rail comprising a side-rail support base adapted to be positioned under a mattress in a stationary position and a side rail including a stationary foundation unit coupled to the side-rail support base to extend upwardly along and above a perimeter side edge of the mattress and a movable barrier unit mounted for up-and-down movement on the stationary foundation unit relative to the side-rail support base between a lowered clamped position to clamp the mattress between the side-rail support base and the movable barrier unit and a raised unclamped position separated from the mattress to unclamp the mattress, wherein the movable barrier unit includes an inclined inner panel that includes a lower portion that is arranged to overlie a top surface of the mattress to extend along an offset mattress-contact line that is provided on the top surface of the mattress and arranged to lie in spaced-apart relation to the perimeter side edge of the mattress when the side-rail support base is positioned under the mattress and the movable barrier unit occupies the lowered clamped position, the inclined inner panel includes an outwardly facing surface arranged to face toward the stationary foundation unit and an inwardly facing surface arranged to face away from the stationary foundation unit and toward a person at rest on the mattress, and the inwardly facing surface of the inclined inner panel and the top surface of the mattress cooperate to define an obtuse included angle therebetween when the movable barrier unit occupies the lowered clamped position.

2. The bed rail of claim 1, wherein the measure of the obtuse angle is about 105°.

3. The bed rail of claim 1, wherein the movable barrier unit further includes a movable first panel support mounted for up-and-down movement on a first stationary post included in the stationary foundation unit and the inclined inner panel is coupled to the movable first panel support for movement therewith relative to the first stationary post during movement of the movable barrier unit between the lowered clamped position and the raised unclamped position.

4. The bed rail of claim 3, wherein the movable barrier unit further includes a movable second panel support mounted for up-and-down movement on a second stationary post included in the foundation stationary unit and arranged to lie in substantially spaced-apart parallel relation to the first stationary post, a first end portion of the inclined inner panel is coupled to the movable first panel support to move therewith and a second end portion of the inclined inner panel is coupled to the movable second panel support to move therewith and to establish the obtuse angle.

5. The bed rail of claim 3, wherein the measure of the obtuse angle is about 105°.

6. The bed rail of claim 3, wherein the side-rail support base includes a first anchor leg adapted to extend under the mattress and a second anchor leg adapted to extend under the mattress and lie in spaced-apart relation to the first anchor leg and the stationary foundation unit includes a stretcher bar arranged to extend along and in laterally spaced-apart relation to the inclined inner panel, a first foundation coupled to the first anchor leg and to a first end of the stretcher bar and configured to include the first stationary post, and a second foundation coupled to the second anchor leg and to an opposite second end of the stretcher bar and configured to include the second stationary post.

7. The bed rail of claim 6, wherein the first foundation includes a first elbow coupled to an outer end of the first anchor leg and a first T-shaped hub including a first hub segment coupled to the first elbow, a second hub segment coupled to the first stationary post, and a third hub segment coupled to the first end of the stretcher bar and the second foundation includes a second elbow coupled to an outer end of the second anchor leg and a second T-shaped hub including a first hub segment coupled to the second elbow, a second hub segment coupled to the second stationary post, and a third hub segment coupled to the opposite second end of the stretcher bar.

8. The bed rail of claim 7, wherein the movable barrier unit further includes first panel-support lock means arranged to interconnect the first stationary post and the movable first panel support for selectively locking the movable first panel support in a stationary position on the first stationary post of the stationary foundation unit after sliding movement of the movable first panel support on the first stationary post to establish the lowered clamped position of the movable barrier unit so that a first end of the lower portion of the inclined inner panel adjacent to the movable first panel support is placed on the offset mattress-contact line and second panel-support lock means arranged to interconnect the second stationary post and the movable second panel support for selectively locking the movable second panel support in a stationary position on the second stationary post of the stationary foundation unit after sliding movement of the movable second panel support on the second stationary post to help establish the lowered clamped position of the movable barrier unit so that an opposite second end of the lower portion of the inclined inner panel adjacent to the movable second panel support is placed on the offset mattress-contact line.

9. The bed rail of claim 1, wherein the stationary unit includes a first foundation coupled to the a side-rail support base, a second foundation coupled to the side-rail support base and arranged to lie in spaced-apart relation to the first foundation, and a horizontally extending stretcher bar arranged to lie between and interconnect the first and second foundations and the movable barrier unit is mounted for up-and-down movement relative to the side-rail support base on the first and second foundations.

10. The bed rail of claim 9, wherein the first foundation includes a first T-shaped hub coupled to one end of the stretcher bar, a first elbow arranged to lie below the first T-shaped hub and coupled to the side-rail support base, and a first stationary post arranged to extend above the first T-shaped hub and upwardly away from the first elbow to engage and maintain contact with the movable barrier unit during up-and-down movement of the movable barrier unit on the first stationary post relative to the side-rail support base.

11. The bed rail of claim 10, wherein the second foundation includes a second T-shaped hub coupled to another end of the stretcher bar, a second elbow arranged to lie below the second T-shaped hub and coupled to the side-rail support, and a second stationary post arranged to extend above the second T-shaped hub and upwardly away from the second elbow to engage and maintain contact with the mobile barrier unit during up-and-down movement of the movable barrier unit on the second stationary post relative to the side-rail support base.

12. The bed rail of claim 11, wherein the side rail further includes a lock system coupled to each of the first stationary post and the movable barrier unit and configured to provide operator-controlled means for moving the movable barrier unit on the first stationary post relative to the side-rail support base.

13. The bed rail of claim 12, wherein the lock system includes a first ratchet associated with the first stationary post.

14. The bed rail of claim 12, wherein the second foundation includes a second T-shaped hub coupled to another end of the stretcher bar, a second elbow arranged to lie below the second T-shaped hub and coupled to the side-rail support, and a second stationary post arranged to extend above the second T-shaped hub and upwardly away from the second elbow to engage and maintain contact with the movable barrier unit during up-and-down movement of the movable barrier unit on the second stationary post relative to the side-rail support base and the motion-control system further includes a second ratchet associated with the second stationary post.

15. A bed rail comprising a side rail including an inclined inner panel, a side-rail support base coupled to a lower portion of the side rail and arranged to be inserted into a space provided between a mattress and a box spring underlying the mattress to support the side rail in an upright orientation extending along an outwardly facing perimeter side edge of the mattress, wherein the side rail further includes a stationary unit coupled to the side-rail support base, the stationary unit includes two upright stationary posts arranged to lie in spaced-apart parallel relation to one another to define a vertical reference plane, the side rail also includes a movable panel-support mounted for up-and-down movement on each of the upright stationary posts under the control of a caregiver, the inclined inner panel has an upper portion coupled to the movable panel supports included in the side rail and a lower portion that is arranged to extend downwardly toward the underlying base to mate with a mattress lying on the base, the inclined inner panel is arranged to lie in angular relation to the vertical reference plane established by the upright stationary posts in the side rail to slope downwardly toward an inner region on the top surface of the mattress, the inclined inner panel is arranged to be moved on the movable panel supports included in the side rail relative to the side-rail support base to trap the mattress therebetween so that the bed rail is clamped to the mattress, the lower portion of the inclined inner panel is arranged to overlie a top surface of the mattress to extend along an offset mattress-contact line that is arranged to lie in spaced-apart relation to the perimeter side edge of the mattress, and wherein the mattress includes a shell formed to include an interior region and the top surface and vertically oriented mattress springs located in the interior region of the shell and the distance between the perimeter side edge and the offset mattress-contact line is greater than a horizontally extending width of an outermost vertically oriented spring located in the interior region of the shell of the mattress.

16. The bed rail of claim 15, further comprising a motion-control mechanism provided in the side rail to provide operator-controlled means for moving the movable first and second panel supports included in the side rail and the inclined inner panel as a unit up and down on the upright stationary posts that are coupled to the side-rail support base and to a mattress that extends into a space provided between the base and a lower portion of the inclined inner panel to cause a movable barrier unit comprising the first and second panel supports and the inclined inner panel mounted on the first and second panel supports to move downwardly toward the underlying base to apply clamping force to the mattress lying therebetween.

17. The bed rail of claim 16, wherein the motion-control mechanism includes a first ratchet associated with the first stationary post and a second ratchet associated with the second stationary post.

18. The bed rail of claim 15, wherein the stationary unit includes a first foundation coupled to the side-rail support base, a second foundation coupled to the side-rail support base and arranged to lie in spaced-apart relation to the first foundation, and a horizontally extending stretcher bar arranged to lie between and interconnect the first and second foundations and the inclined inner panel is mounted for up-and-down movement relative to the side-rail support base on the first and second foundations.

19. The bed rail of claim 18, wherein the first foundation includes a first T-shaped hub coupled to one end of the stretcher bar, a first elbow arranged to lie below the first T-shaped hub and coupled to the side-rail support base, and a first stationary post arranged to extend above the first T-shaped hub and upwardly away from the first elbow to engage and maintain contact with the inclined inner panel during up-and-down movement of the movable barrier unit on the first stationary post relative to the side-rail support base.

20. A bed rail comprising a side-rail support base adapted to be positioned under a mattress in a stationary position and a side rail including a stationary foundation unit coupled to the side-rail support base to extend upwardly along and above a perimeter side edge of the mattress and a movable barrier unit mounted for up-and-down movement on the stationary foundation unit relative to the side-rail support base between a lowered clamped position to clamp the mattress between the side-rail support base and the movable barrier unit and a raised unclamped position separated from the mattress to unclamp the mattress, wherein the movable barrier unit includes an inclined inner panel coupled to inclined panel supports, the inclined inner panel includes a lower portion that is arranged to overlie a top surface of the mattress to extend along an offset mattress-contact line that is provided on the top surface of the mattress and arranged to lie in spaced-apart relation to the perimeter side edge of the mattress when the side-rail support base is positioned under the mattress and the movable barrier unit occupies the lowered clamped position, the inclined inner panel includes an outwardly facing surface arranged to face toward the stationary foundation unit and an inwardly facing surface arranged to face away from the stationary foundation unit and toward a person at rest on the mattress, and the inwardly facing surface of the inclined inner panel and the top surface of the mattress cooperate to define an obtuse included angle therebetween when the movable barrier unit occupies the lowered clamped position.

* * * * *